US006660232B1

(12) United States Patent
Krueger et al.

(10) Patent No.: US 6,660,232 B1
(45) Date of Patent: Dec. 9, 2003

(54) MULTI-WELL ASSAY PLATE AND PLATE HOLDER AND METHOD OF ASSEMBLING THE SAME

(75) Inventors: Steven T. Krueger, Deerfield, WI (US); Paul E. Otto, Madison, WI (US); Julia E. Krueger, Deerfield, WI (US)

(73) Assignee: Promega Corporation, Madison, WI (US)

( * ) Notice: Subject to any disclaimer, the term of this patent is extended or adjusted under 35 U.S.C. 154(b) by 75 days.

(21) Appl. No.: 09/676,184

(22) Filed: Sep. 29, 2000

(51) Int. Cl.[7] ..... B01L 3/00

(52) U.S. Cl. ..... 422/102; 422/99; 422/104; 435/283.1

(58) Field of Search ..... 422/99, 101, 102, 422/940–942, 104; 435/283.1, 287.8, 288.3, 288.4

(56) References Cited

U.S. PATENT DOCUMENTS

| | | | | | |
|---|---|---|---|---|---|
| 2,871,168 | A | | 1/1959 | Salisbury | |
| 4,038,149 | A | | 7/1977 | Liner et al. | |
| 4,484,907 | A | | 11/1984 | Sheeran, Jr. | |
| 4,599,314 | A | | 7/1986 | Shami | |
| 4,657,867 | A | | 4/1987 | Guhl et al. | |
| 4,673,651 | A | | 6/1987 | Rothenberg et al. | |
| 4,786,601 | A | | 11/1988 | Rothenberg | |
| 4,948,564 | A | * | 8/1990 | Root et al. | 422/101 |
| 5,084,246 | A | * | 1/1992 | Lyman et al. | 422/101 |
| 5,141,719 | A | * | 8/1992 | Fernwood et al. | 422/101 |
| 5,188,733 | A | * | 2/1993 | Wang et al. | 210/321.84 |
| 5,308,584 | A | * | 5/1994 | Vauramo | 422/104 |
| 5,459,300 | A | | 10/1995 | Kasman | |
| 5,475,610 | A | * | 12/1995 | Atwood et al. | 364/500 |
| 5,516,490 | A | * | 5/1996 | Sanadi | 422/101 |
| 5,554,536 | A | | 9/1996 | Rising | |
| 5,567,326 | A | | 10/1996 | Ekenberg et al. | |
| 5,587,321 | A | | 12/1996 | Smith et al. | |
| 5,604,130 | A | | 2/1997 | Warner et al. | |
| 5,681,743 | A | | 10/1997 | Brian et al. | |
| 5,741,463 | A | * | 4/1998 | Sanadi | 422/101 |
| 5,817,510 | A | | 10/1998 | Pandey et al. | |
| 5,916,526 | A | * | 6/1999 | Robbins | 422/102 |
| 5,950,832 | A | * | 9/1999 | Perlman | 206/446 |
| 6,054,100 | A | * | 4/2000 | Stanchfield et al. | 422/102 |
| 6,258,325 | B1 | * | 7/2001 | Sanadi | 422/101 |
| 6,277,630 | B1 | * | 8/2001 | Brophy et al. | 435/288.4 |
| 6,315,957 | B1 | * | 11/2001 | Feygin et al. | 422/101 |
| 6,340,589 | B1 | * | 1/2002 | Turner et al. | 435/287.2 |

FOREIGN PATENT DOCUMENTS

| | | |
|---|---|---|
| EP | 1 000 661 A1 | 5/2000 |
| WO | WO 99/42608 | 8/1999 |

* cited by examiner

*Primary Examiner*—Jill Warden
*Assistant Examiner*—Dwayne K Handy
(74) *Attorney, Agent, or Firm*—Michael Best & Friedrich, LLP; Grady H. Frenchick; Charlene L. Yager

(57) ABSTRACT

A multi-well plate and plate holder assembly comprising a multi-well assay plate clamped between an upper plate holder and a lower plate holder to facilitate handling of the plate, and to prevent the plate from warping when liquid samples placed within wells of the multi-well assay plate are stored, analyzed and/or subjected to a reaction or other process, particularly when the samples are subjected to high temperatures. The upper plate holder is releasably engageable with the lower plate holder. Preferably, at least one detent positions and holds the upper plate holder in relation to the lower plate holder.

17 Claims, 2 Drawing Sheets

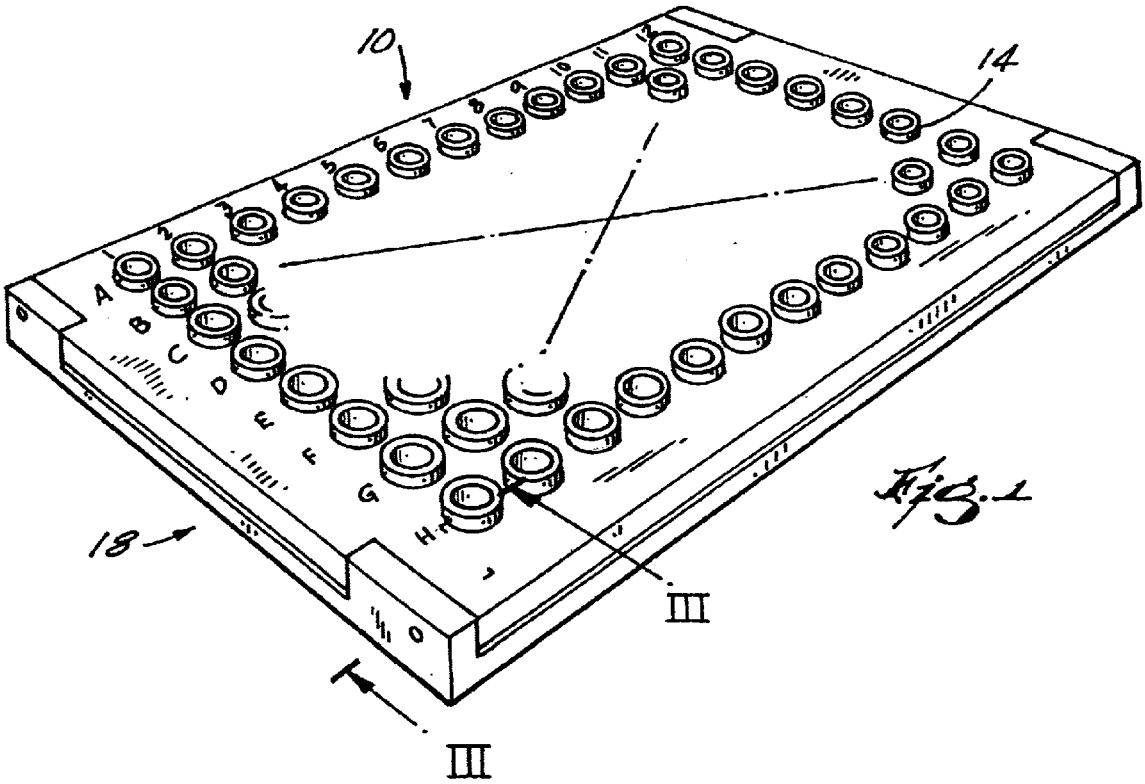
Fig. 1
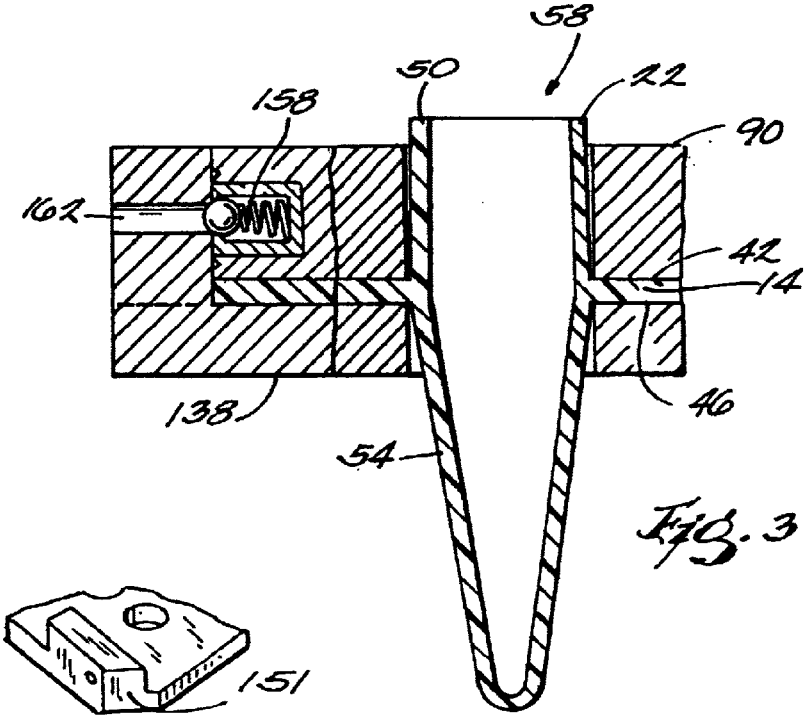
Fig. 3
Fig. 4

MULTI-WELL ASSAY PLATE AND PLATE HOLDER AND METHOD OF ASSEMBLING THE SAME

FIELD OF THE INVENTION

The present invention relates generally to multi-well containers, such as microtitration plates, for multi-sample fluid handling systems.

BACKGROUND OF THE INVENTION

Patient health care and biological research have made dramatic improvements in recent years, in part due to the utilization of assay techniques. Laboratory and clinical procedures involving biospecific affinity reactions are commonly employed in testing biological samples, such as blood or urine, for the identification and/or quantification of a wide range of target substances, such as particular chemical substances that have been correlated or associated with various disease conditions. The efficiency with which various tests, reactions, assays and the like can be performed in biology, clinical diagnostics, and other areas, has been greatly increased by adoption of parallel sample handling techniques. Specific examples include polymerase chain reaction (PCR) techniques, enzyme-linked immunosorbent assay (ELISA), enzyme immune assay (EIA), radioimmune assay (RIA), membrane capture assays, cell washing, enzyme assays, receptor binding assays, other molecular biological reactions and washes, and the like. In most of these procedures, samples are processed in multi-well or multi-well assay plates.

One of the most common plate formats is a 96-well assay plate, wherein the wells are arranged in a matrix having 8 lettered rows and 12 numbered columns. Multi-well assay plates may be manually handled or handled by automated systems. Known automated systems include robotic devices for use in various procedures including thermal cycling of PCR reactions, luminometers, plate readers and the like. Fluids may be transferred between selected wells, and the plates may be manipulated for storing, reacting and/or analyzing the samples.

During certain processing steps, the samples (and the plates holding the samples) may be heated. Under extreme temperatures, it is not uncommon for the multi-well assay plates to warp. A warped multi-well assay plate is difficult to effectively utilize and handle.

SUMMARY OF THE INVENTION

Accordingly, there is a need for an assembly that prevents or reduces the likelihood of a multi-well assay plate from warping as a result of exposure to extreme heating conditions. There is also a need for an assembly that facilitates and improves the handling of a multi-well assay plate. Thus, it is desirable to provide an assembly which includes a multi-well assay plate, which is of relatively simple, yet dependable, construction and operation, which improves the handling of the multi-well assay plate, and which is of practical utility for use in various laboratory and clinical procedures.

Briefly, the present invention includes a multi-well assay plate and plate holder and a method of assembling the same. The plate holder engages a top side and a bottom side of the multi-well assay plate. The plate holder holds the multi-well assay plate to prevent or substantially inhibit the ability of the multi-well assay plate to warp when the multi-well assay plate is subjected to changing temperatures. The plate holder enhances the ease in which the multi-well assay plate can be manually or mechanically handled. In one embodiment, the plate holder includes an upper portion designed to be positioned above the multi-well assay plate, and a lower portion designed to be positioned under the multiwell assay plate. The upper portion is releasably engaged to the lower portion to sandwich and hold the multi-well assay plate therebetween. Preferably, the plate holder includes at least one detent for positioning and holding the upper portion in relation to the lower portion.

Other features and advantages of the invention will become apparent to those skilled in the art upon review of the following detailed description, claims and drawings in which like numerals are used to designate like features.

BRIEF DESCRIPTION OF THE DRAWINGS

FIG. 1 is perspective view of a multi-well assay plate and plate holder assembly according to the present invention.

FIG. 3 is a cross-sectional view taken along line III—III of FIG. 1.

FIG. 4 is an enlarged perspective view of a portion of a modified plate holder illustrating a different embodiment of the present invention.

Figure 2:
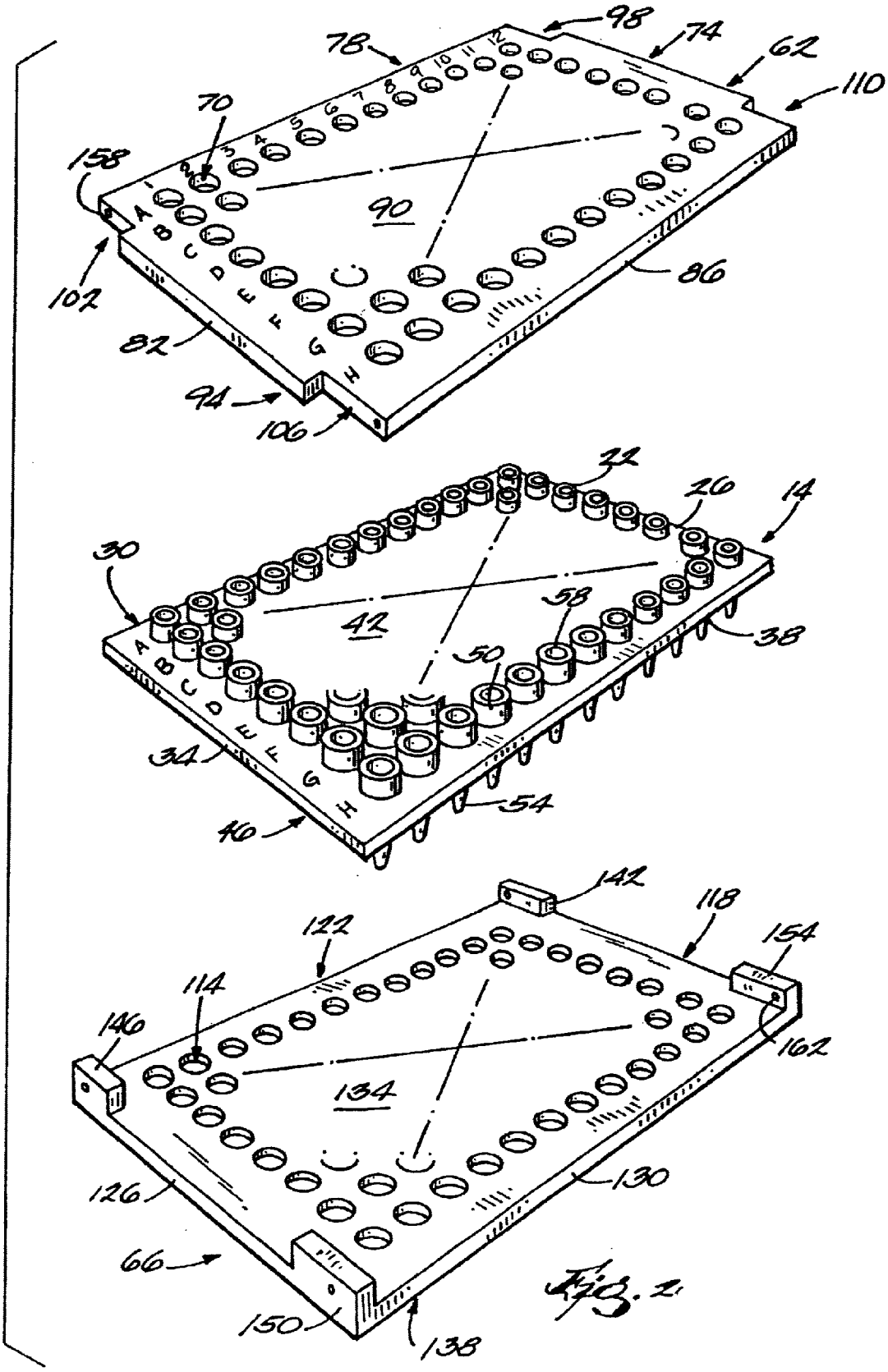
FIG. 2 is an exploded perspective view of the multi-well assay plate and plate holder assembly of FIG. 1.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting.

DETAILED DESCRIPTION OF THE PREFERRED EMBODIMENT

FIG. 1 illustrates a multi-well assay plate and plate holder assembly 10 including a multi-well assay plate 14 and a plate holder 18. As will be further explained below, the plate 14 is held by the plate holder 18 in such a way so as to prevent the plate 14 from warping when the plate 14 is subjected to extreme temperature. Before explaining in detail the features of the assembly 10, the elements of the plate 14 and the plate holder 18 are identified for the sake of clarity.

With reference to FIG. 2, the illustrated plate 14 is shown as having a common 96-well format arranged in an eight by twelve array. Labels in the form of letters and numbers 20 can be used to identify the individual wells. The invention may, of course, be used with other multi-well formats. The wells 22 are shown as being integrally formed with the plate 14 to create a single, one-piece plate 14, but the invention is capable of use with plate assemblies where the wells are not integrally formed with a plate. The plate 14 is preferably made of plastic, but can be made of other suitable material. The plate 14 is substantially rectangular having a first side 26, a second side 30, a third side 34 and a fourth side 38, all of which extend between a top side 42 and a bottom side 46. The wells 22 extend through the top side 42 and the bottom side 46. Each well 22 includes an upper portion 50 which extends from the top side 42 of the plate 14 and a lower portion 54 which extends from the bottom side 46 of the plate 14 (see also FIG. 3). The upper portion 50 includes an opening 58 for receiving a fluid sample which is stored, analyzed or subjected to a reaction, in accordance with the desired procedure.

With continued reference to FIG. 2, the plate holder 18 includes an upper plate holder 62 and a lower plate holder 66. The illustrated upper plate holder 62 and the illustrated lower plate holder 66 are substantially rectangular and flat. Preferably, the upper plate holder 62 and the lower plate holder 66 are made of a non-warping material, such as aluminum or a heat resistant plastic material, but may be made of other suitable material. Preferably the material of the plate holders is stiffer than the material of the plate. The upper plate holder 62 has a plurality of openings 70, one for each well 22, a first side 74, a second side 78, a third side 82 and a fourth side 86, all of which extend between a top side 90 and a bottom side 94. The top side 90 includes labels in the form of letters and numbers 96 in order to facilitate identification of the individual wells. The upper plate holder 62 further has a first L-shaped notch 98 extending between the first side 74 and the second side 78, a second L-shaped notch 102 extending between the second side 78 and the third side 82, a third L-shaped notch 106 extending between the third side 82 and the fourth side 86, and a fourth L-shaped notch 110 extending between the first side 74 and the fourth side 86. The lower plate holder 66 has a plurality of openings 114, one for each well 22, a first side 118, a second side 122, a third side 126 and a fourth side 130, all of which extend between a top side 134 and a bottom side 138. The lower plate holder 66 further has a first substantially rectangular projection 142, a second substantially rectangular projection 146, a third substantially rectangular projection 150 and a fourth substantially rectangular projection 154, all of which extend from the top side 134.

Although not clearly shown in FIG. 2, for reasons which will be further explained below, each notch 98, 102, 106 and 110 of the upper plate holder 62 includes a detent 158 and each projection 142, 146, 150 and 154 of the lower plate holder 66 includes a detent receiving hole or bore 162. FIG. 3 is representative of the cooperation between the detents 158 and the detent receiving holes 162. FIG. 3 best shows the combination of the detent 158 of notch 106 (FIG. 2) and the detent receiving hole 162 of the projection 150 (FIG. 2). It should be understood that the invention can include any number of detents.

Having described in detail the components of the plate 14 and plate holder 18, the overall assembly of the multi-well plate and plate holder 10 will now be explained in greater detail taking into account FIGS. 1–3.

The upper plate holder 62 is releasably engaged with the lower plate holder 66 to sandwich and hold the multi-well assay plate 14 therebetween. The plurality of openings 70 of the upper plate holder 62 align with and receive the upper portions 50 of the wells 22, and the plurality of openings 114 of the lower plate holder 66 align with and receive the lower portions 54 of the wells 22. So as to allow for the proper use of the wells 22 during certain laboratory and clinical procedures, the upper portions 50 of the wells 22 extend beyond the top side 90 of the upper plate holder 62 and the bottom portions 54 extend beyond the bottom side 138 of the lower plate holder 66. The bottom side 94 of the upper plate holder 62 engages the top side 42 of the plate 14 and the top side 134 of the lower plate holder 66 engages the bottom side 46 of the plate 14. Notches 98, 102, 106 and 110 of the upper plate holder 62 receive the projection members 142, 146, 150 and 154 of the lower plate holder 66, respectively. The detents 158 of the upper plate holder 62 are received by the associated detent receiving holes 162 of the lower plate holder 66 to hold the upper plate holder 62 to the lower plate holder 66. So assembled, the multi-well assay plate 14 is more easily handled, as compared to a plate standing by itself. Moreover, because the upper plate holder 62 and the lower plate holder 66 are made of a non-warping or stiff material and are generally flat, the plate holder 18 will prevent the multi-well assay plate 14 from warping when, for example, the plate 14 is subjected to high temperatures, thereby eliminating the problems associated therewith. To release the upper plate holder 62 from the lower plate holder 66, a force is simply applied to the tops of each projection member 142, 146, 150 and 154 to separate the detents 158 from the detent receiving holes 162.

Variations and modifications are within the scope of the present invention. For example, the lower plate holder 66 could include a diagonal corner 151 (FIG. 4) so that a PCR machine or the like can detect the corner 151 to determine the position of the multiwell assay plate relative to the machine. As another example, the upper plate holder 62 and the lower plate holder 66 need not be separable from each other and could be hinged or otherwise coupled to each other. It is understood that the invention disclosed and defined herein extends to alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A multi-well plate and plate holder assembly comprising:

a multi-well assay plate having a top side, a bottom side and a plurality of wells extending therethrough;

an upper plate holder engaging said top side of said multi-well assay plate; and a lower plate holder engaging said bottom side of said multi-well assay plate;

wherein said multi-well assay plate comprises a first material, and wherein said upper plate holder and said lower plate holder each comprise a second material that is stiffer than said first material, such that said upper plate holder and said lower plate holder inhibit said multi-well assay plate from warping.

2. A multi-well plate and plate holder assembly according to claim 1, wherein said upper plate holder is engaged with said lower plate holder.

3. A multi-well plate and plate holder assembly according to claim 1, wherein said upper plate holder is releasably engaged with said lower plate holder.

4. A multi-well plate and plate holder assembly according to claim 1, wherein said multi-well assay plate comprises a plastic material, and wherein said upper plate holder and said lower plate holder each comprise aluminum.

5. A multi-well plate and plate holder assembly according to claim 1, wherein said wells include upper portions extending from said top side of said multiwell assay plate and lower portions extending from said bottom side of said multi-well assay plate, wherein said lower portions of said wells extend beyond said lower plate holder.

6. A multi-well plate and plate holder assembly according to claim 5, wherein said upper portions of said wells extend beyond said upper plate holder.

7. A multi-well plate and plate holder assembly comprising:

a multi-well assay plate having a top side, a bottom side and a plurality of wells extending therethrough:

an upper plate holder engaging said top side of said multi-well assay plate; and a lower plate holder engaging said bottom side of said multi-well assay plate;

wherein said multi-well assay plate comprises a first material, and wherein said upper plate holder and said lower plate holder each comprise a second material that is stiffer than said first material, such that said upper plate holder and said lower plate holder inhibit said multi-well assay plate from warping;

wherein said upper plate holder includes a top side, a bottom side, and a plurality of openings aligned with said wells, said bottom side of said upper plate holder engaging said top side of said multi-well assay plate, and wherein said lower plate holder includes a top side, a bottom side and a plurality of openings aligned with said wells, said top side of said lower plate holder engaging said bottom side of said multi-well assay plate, and said upper plate holder being releasably engaged with said lower plate holder to sandwich and hold said multi-well assay plate therebetween.

8. A multi-well plate and plate holder assembly comprising:

a multi-well assay plate having a top side, a bottom side and a plurality of wells extending therethrough;

an upper plate holder engaging said top side of said multi-well assay plate; and a lower plate holder engaging said bottom side of said multi-well assay plate;

wherein said multi-well assay plate comprises a first material, and wherein said upper plate holder and said lower plate holder each comprise a second material that is stiffer than said first material, such that said upper plate holder and said lower plate holder inhibit said multi-well assay plate from warping;

wherein one of said upper plate holder and said lower plate holder includes a detent and the other includes a detent receiving hole that receives said detent.

9. A multi-well plate and plate holder assembly comprising:

a multi-well assay plate having a top side, a bottom side and a plurality of wells extending therethrough;

an upper plate holder engaging said top side of said multi-well assay plate; and a lower plate holder engaging said bottom side of said multi-well assay plate;

wherein said multi-well assay plate comprises a first material, and wherein said upper plate holder and said lower plate holder each comprise a second material that is stiffer than said first material, such that said upper plate holder and said lower plate holder inhibit said multi-well assay plate from warping;

wherein one of said upper plate holder and said lower plate holder includes a projecting member and the other of said upper plate holder and said lower plate holder includes a notch that receives said projecting member.

10. A multi-well plate and plate holder assembly according to claim 1, wherein said upper plate holder is labeled with numbers and letters to identify the wells.

11. A multi-well plate and plate holder assembly comprising:

a substantially rectangular multi-well assay plate having a first side, a second side, a third side and a fourth side, all of which extend between a top side and a bottom side, and a plurality of wells extending through said top side and said bottom side, each of said wells having an upper portion extending from said top side of said multi-well assay plate and a lower portion extending from said bottom side of said multi-well assay plate, wherein said wells are integrally formed with said multi-well assay plate to create a single, one-piece multi-well assay plate;

a substantially rectangular flat upper plate holder having a plurality of openings, one for each well, a first side, a second side, a third side and a fourth side, all of which extend between a top side and a bottom side, a first L-shaped notch extending between said first side and said second side, a second L-shaped notch extending between said second side and said third side, a third L-shaped notch extending between said third side and said fourth side and a fourth L-shaped notch extending between said first side and said fourth side, each of said notches including a detent; and a substantially rectangular flat lower plate holder having a plurality of openings, one for each well, a first side, a second side, a third side and a fourth-side, all of which extend between a top side and a bottom side, a first substantially rectangular projecting member, a second substantially rectangular projecting member, a third substantially rectangular projecting member and a fourth substantially rectangular projecting member, all of which extend from said top side, each projecting member including a detent receiving hole, such that said upper plate holder is releasably engageable with said lower plate holder to sandwich and hold said multi-well assay plate therebetween, and such that when said multi-well assay plate is sandwiched and held between said upper plate holder and said lower plate holder, said top side of said multi-well assay plate engages said bottom side of said upper plate holder, said bottom side of said multi-well assay plate engages said top side of said lower plate holder, each opening of said upper plate holder receives the associated upper portion of the associated well, each opening of said lower plate holder receives the associated lower portion of the associated well, each notch of said upper plate holder receives the associated projecting member of said lower plate holder and each detent receiving hole of said lower plate holder receives the associated detent of said upper plate holder, thereby inhibiting said multi-well assay plate from warping.

12. A multi-well plate and plate holder assembly according to claim 11, wherein when said upper plate holder engages said lower plate holder, a portion of each upper portion of each of said wells extends above said top side of said upper plate holder and a portion of each lower portion of each of said wells extends below said bottom side of said lower plate holder.

13. A multi-well plate and plate holder assembly according to claim 11, wherein said lower plate holder includes a diagonally shaped corner.

14. A method of assembling a multi-well plate and plate holder assembly comprising the steps of:

providing a multi-well assay plate having a top side, a bottom side and a plurality of wells extending therethrough; positioning an upper plate holder into engagement with the top side of the multi-well assay plate; positioning a lower plate holder into engagement with the bottom side of the multi-well assay plate; and limiting movement of the upper plate holder relative to the lower plate holder, thereby sandwiching the multi-well assay plate therebetween;

wherein said multi-well assay plate comprises a first material, and wherein said upper plate holder and said lower plate holder each comprise a second material that is stiffer than said first material, such that said upper plate holder and said lower plate holder inhibit warping of the multi-well assay plate;

wherein said step of positioning the lower plate holder includes aligning a plurality of openings in the lower plate holder with the plurality of wells in the multi-well assembly plate.

15. A method of assembling a multi-well plate and plate holder assembly according to claim 14, wherein said step of positioning the upper plate holder includes aligning a plurality of openings in the upper plate holder with the plurality of wells in the multi-well assay plate.

16. A method of assembling a multi-well plate and plate holder assembly according to claim 14, wherein said limiting step includes securing the upper plate holder to the lower plate holder.

17. A method of assembling a multi-well plate and plate holder assembly according to claim 16, wherein said limiting step includes releasably engaging the upper plate holder with the lower plate holder.

* * * * *